US005265737A

United States Patent [19]

Freeby

[11] Patent Number: 5,265,737

[45] Date of Patent: Nov. 30, 1993

[54] PORTABLE, SWIVEL VISOR CAP RACK

[76] Inventor: John J. Freeby, 9216 Nall Ave., Overland Park, Kans. 66207

[21] Appl. No.: 848,713

[22] Filed: Mar. 9, 1992

[51] Int. Cl.[5] ..... A47F 7/00

[52] U.S. Cl. ..... 211/30; 211/115

[58] Field of Search ..... 211/113, 115, 30

[56] References Cited

U.S. PATENT DOCUMENTS

| | | | |
|---|---|---|---|
| D. 93,143 | 8/1934 | Spragg | 211/113 X |
| D. 184,686 | 3/1959 | Rosene | 211/113 X |
| 1,608,758 | 11/1926 | Alexander | 211/30 |
| 2,246,081 | 6/1941 | Van Nattan | 211/124 |
| 2,514,742 | 7/1950 | Burger et al. | 211/113 |
| 2,612,274 | 9/1952 | Earll | 211/113 X |
| 3,411,735 | 11/1968 | Hurd | 211/113 X |
| 3,436,839 | 9/1967 | Wheeler | 211/124 |
| 3,946,878 | 3/1976 | Stoveken et al. | 211/124 |
| 4,709,838 | 12/1987 | Campbell | 211/115 X |
| 5,002,190 | 3/1991 | Moreland | 211/32 |

*Primary Examiner*—Alvin C. Chin-Shue
*Assistant Examiner*—Sarah A. Lechok
*Attorney, Agent, or Firm*—Kenneth W. Iles

[57] ABSTRACT

A cap rack for storage or display of caps having a bill or visor, such as baseball caps, tennis visors or golf hats, comprises a longitudinal member having a vertical axis and including a plurality of slots formed into the member at a specified angle to the horizontal. A cap can be retained in each slot by the bill of the cap. A hook at the top of the cap rack allows the rack to be suspended from any convenient place. The hook is fixed to the cap rack by a blind swivel connection, allowing the cap rack to be rotated to gain easy access to any single cap.

6 Claims, 1 Drawing Sheet

PORTABLE, SWIVEL VISOR CAP RACK

BACKGROUND OF THE INVENTION

1. Field of the Invention

The present invention is related to an apparatus for hanging and storing hats or caps. More particularly, the present invention is directed to an apparatus for conveniently holding a plurality of caps having bills, such as baseball-style caps or tennis visors for display or storage.

2. Description of Related Art Including Information Disclosed Under 37 C.F.R. Sections 1.97–1.99

Caps having a bill, such as baseball caps, golf caps or visors and tennis visors (hereinafter collectively referred to as "caps") have become increasingly popular to cover the head and shield the eyes from the sun, and to display allegiance to a particular association, company or place. Further, many people actively collect caps in many colors, styles. Collectors sometimes have collections numbering in the hundreds. In addition, wholesale and retail stores must display many different types of caps, especially baseball caps, in some fashion that allows all the different caps to be easily seen by customers.

Storing or displaying more than a few caps presents significant problems, for such large numbers of caps take up a substantial amount of space, which may not be available in the average home and is valuable space in retail stores.

Many attempts to address the storage and display problems associated with large collections or inventories of caps have lead to a number of issued United States Patents, some of which are discussed below U.S. Pat. No. 5,005,190, issued to Moreland on Mar. 26, 1991 (Moreland '190) discloses a "Sports Cap Rack" comprising an elongated vertical member pivotally mounted at the top of the member and having a plurality of cap holding elements distributed at intervals along the length of the vertical member. The cap holding elements further comprise brackets shaped to retain a cap with the crown filled out, that is, in approximately the shape the cap has when worn by a person. Moreland '190 includes a plurality of members, which makes manufacturing and set-up more complex, expensive and inconvenient than it might be.

U.S. Pat. No. 3,946,878, issued to Stoveken et al. on Mar. 30, 1986 (Stoveken et al. '878), discloses a "Message Holder Rack" comprising a bottom base with a vertical support member at each end and a horizontal cable strung between the vertical support member. A plurality of cylindrical spacers and snap clothespins are strung alternately along the string. Stoveken et al. '878 could be adopted to hold caps by the bill, but this use would not provide a good presentation of caps because the inside of the caps would be visible. Further, it would tend to cause undue wear on the bill of the cap due to the spring tension in the spring clothes pin.

U.S. Pat. No. 3,343,638, issued to Wheeler on Sep. 26, 1967 (Wheeler '638) discloses a "Rack for Socks" comprising an elongated member that is horizontally mounted on a wall and includes a plurality of vertically oriented snap clothespins distributed along the length of a rod mounted on the elongated member. Wheeler '638, like Stoveken et al. '878, could be adopted for the display of caps, and suffers from the same shortcomings.

U.S Pat. No. 2,246,081, issued to Van Nattan on Jun. 17, 1941 (Van Nattan '081), discloses a "Display Rack for Belts" comprising a free standing rack having a frame for holding a horizontal bar. The horizontal bar includes a plurality of depending hooks, each of which can hold a belt. Caps could be suspended from the hooks, but the display would show the insides of the caps, obscuring logos, names and the like that are frequently placed near the crown of the cap. Further, such a storage system does not utilize vertical space well, as it consists of only a single horizontal member.

U.S. Pat. No. 1,608,758, issued to Alexander on Nov. 30, 1926 (Alexander '758) discloses a "Supporting Device for Caps" comprising a plurality of horizontal members, each further comprising a pair of spaced rails that retain a plurality of curled spring hooks. Each hook holds one cap by the bill. The device of Alexander '758 is relatively complex and expensive to manufacture. The metal spring clips may mar the bill of the cap due to excess pressure or corrosion of the metal.

The related art discussed above discloses the idea of providing a rack for holding baseball caps (Moreland '109 and Alexander '758). The use of a vertically oriented member for holding a plurality of vertically spaced cap holder elements is disclosed in Moreland '190. The concept of a cap holder that hold caps by the bill is disclosed in Alexander '758.

Not disclosed in the related art patents discussed above, however, is a simple, inexpensive apparatus or device for displaying a plurality of caps along a longitudinal, preferably vertical axis that includes a minimum of parts and is suitable for either storage or display of caps, either in the home or in retail shops. More particularly, the related art patents discussed above do not disclose the use of a plurality of offset slots for holding caps by the bill and that swivels 360 degrees about its longitudinal axis.

Therefore, a need exists for a portable mobil swivel cap rack that displays a plurality of caps along a longitudinal, vertical axis, and that is suitable for use either in the home or in retail shops and for either display or storage of caps and that swivels 360 degrees about its longitudinal and that is simple and inexpensive to manufacture, ship, set-up and use and that uses space well.

SUMMARY OF THE INVENTION

Accordingly, it is a primary object of the present invention to provide a portable swivel cap rack that stores a plurality of caps.

It is a further object of the present invention to provide a portable swivel cap rack that swivels 360 degrees about a longitudinal axis for ready access to any cap in the rack.

It is a further object of the present invention to provide a portable swivel cap rack that utilizes storage or display space well.

It is a further object of the present invention to provide a portable swivel cap rack that holds caps by the bill through friction and the force of gravity.

It is a further object of the present invention to provide a portable swivel cap rack that is suitable for either display or storage of caps, either in the home or in a retail store.

It is a further object of the present invention to provide a portable swivel cap rack that does not scratch, mar, or unduly wear the bills of caps.

The cap rack comprises an elongated member, such as a wooden board, a plastic member, or other member having a hook on one end for suspending the unit vertically. The hook is preferably fastened into the vertical member by a blind swivel member, as shown in the drawing.

The elongated member includes a plurality of slots cut toward the centerline of the board at an angle of about 20-30 degrees, with the preferred angle being 22.5 degrees from the horizontal. Each side of the vertical member includes a plurality of such slots. The two sets of slots are offset from one another to provide a more attractive display and allow use of a narrower vertical member than would be required if the slots were directly opposite of each other.

In use, the bill of a cap or a visor is inserted into one of the slots. The slots are sized to accommodate the bill of a typical cap with a small amount of friction, that, along with the downward pull of gravity, keeps the cap in place in the rack. If the angle is too steep, the cap may tilt toward on side or the other and fall from the slot. If the slot is too close to the horizontal, or below the horizontal, a cap may to fall out of the slots.

The cap rack according the to present invention can be transported even when filled with caps. Further, the capacity of the cap rack can be increased or decreased simply be changing the length and the corresponding number of slots, adding further flexibility in meeting consumer needs. The cap rack is readily mobile and can be carried in a car, stored in a motel closet, and so forth, allowing it to be used easily on vacations and other travels. The cap rack can be also be used to hold wet or damp caps, providing a convenient place for drying them. Finally, the cap rack according to the present invention requires no consumer assembly and only the most limited instructions, making the cap rack convenient and easy for consumers to use.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENT

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
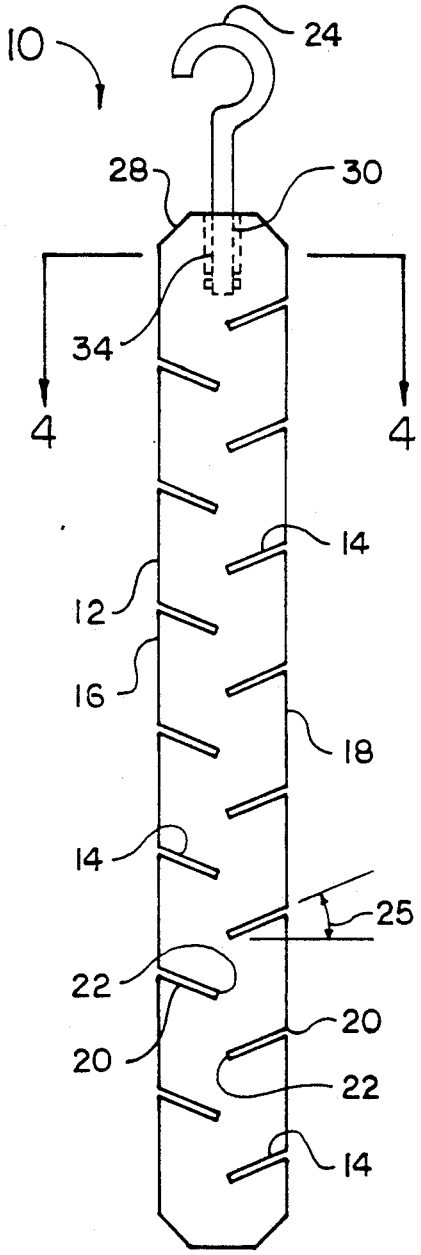
FIG. 1 is front elevation of the cap rack of the present invention.
Figure 2:
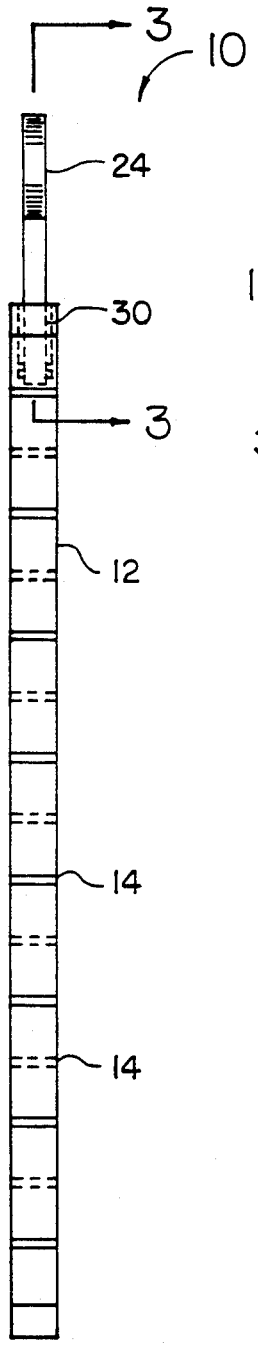
FIG. 2 is a side elevation of the cap rack of FIG. 1.

Referring to FIGS. 1, 2 there is shown a front elevation of the portable swivel cap rack 10 according to the present invention. The portable swivel cap rack 10 includes an elongated member 12, which may be made from wood, plastic, or the like which can be dressed and finished to present a pleasing finished appearance suitable for display. A plurality of slots 14 are formed into the elongated member 12, by cutting, molding, or the like, with the cuts arranged in a left-hand column 16 and a right-hand column 18. In the preferred embodiment shown here, the slots 14 within each column are separated by about 4-6 inches (10.5-15.25 cm) from center to center, with the preferred separation being 5.25 inches 13.335 cm) between centers. It has been found that this separation allows the caps to be displayed close together, while maintaining sufficient space between adjacent caps to allow the crowns to be fully formed and displayed when one cap is inserted into each slot 14 by the bill.

Still referring to FIGS. 1, 2, in the preferred embodiment, each slot in the right-hand column 18 are off-set from each slot in the left-hand column 16 by a distance that is about one-half of the distance between adjacent slots in the left-hand column 16. This arrangement maintains the tensile strength of the elongated member 12, allowing it to be narrower than it could be if the slots 14 from each column 16, 18 were arranged exactly opposite from one another.

The slots 14 are about 0.100-0.500 inches (0.254-1.27 cm) wide, with the preferred width being about 0.200 inches (0.508 cm) and have parallel side walls or edges, and have uniform widths throughout their lengths, as shown in FIGS. 1, 2 and as required by the uniform widths discussed herein. This width range allows the slots 14 to receive and accommodate the bills of most caps, which are typically about 0.200 inches (0.508 cm) thick. The slots 14 are about 1.10-1.5 inches (2.8-3.8 cm) deep, that is the distance from the front 20 of each slot 14 to the back 22 of each slot 14, with the preferred depth being about 1.1875 inches (3.02 cm). This depth allows the bill or visor of a cap to be inserted into the portable swivel cap rack far enough to hold the cap securely when the angle 25 of the slots 14 is appropriate. The width of the slots 14 is sufficient to accommodate the bill or visor of a cap snugly, while allowing the cap to be inserted into and withdrawn from the portable swivel cap rack 10 easily and without scratching or marring the bill or visor and without damaging the cap. Toward this end, the slots 14 and the edges of the slots 14 can be dressed by sanding or the like if necessary to remove sharp edges, burrs, and the like.

The portable swivel cap rack 10 is intended to be suspended vertically, that is with the long axis of the elongated member 12 being vertically oriented, by hanging the portable swivel cap rack 10 from any convenient place by a hook 24. When so suspended, each slot 14 forms an angle 25 to the horizontal. The angle 25 of each slot 14 to the horizontal lies in a range of about 15-45 degrees, with the preferred angle 25 being 22.5 degrees, with the back end 22 of a slot 14 being lower than the front end 20 of the slot. Each slot 14 is disposed in the same fashion, with the slots 14 in a single column being parallel to one another and the slots 14 in the left-hand column 16 and the right-hand column 18 taken together forming a herringbone-type pattern. It has been found that this preferred angle allows the force of gravity acting on the cap to hold the cap securely within any slot 14.

The hook 24 is a swivel hook that can be rotated 360 degrees about its longitudinal axis, which is a aligned with the longitudinal, or vertical, axis of the elongate member 12, relative to the elongated member 12, allowing easy and ready access to either column 16, 18 of slots 14, and thus the caps displayed therein from any convenient user position. The hook 24 can be made of brass and finished with a clear lacquer, or from other convenient material. The hook 24 preferably has an inside diameter of about 0.75 inches (1.9 cm), which allows the portable cap rack 10 to be hung on any conventional closet rod.

Figure 3:
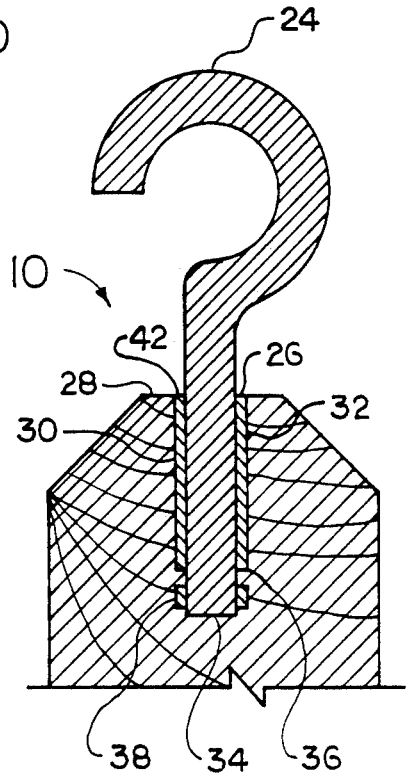
FIG. 3 is a cross section taken along lines 3—3 of FIG. 2.
Figure 4:
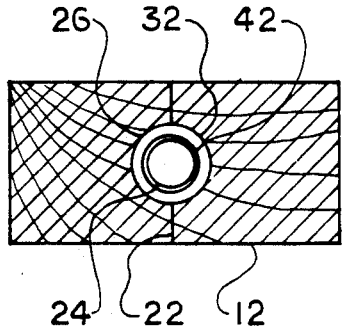
FIG. 4 is a cross section taken along lines 4—4 of FIG. 1.

Referring to FIGS. 3, 4, the hook 24 is fixed into a bore 26 in the upper or top end 28 of the elongated member 12 by a blind swivel mechanism 30. The blind swivel mechanism 30 includes a pipe 32 that is inserted and fixed within the bore 26 by an adhesive, such as an epoxy. The pipe 32 may be threaded to increase the friction and bonding with the side walls of the bore 26 and the pipe 32 fits tightly within the bore 26. The straight end 34 of the hook 24 is inserted into the pipe and extends below the bottom end 36 of the pipe 32, and a fitting 38 is sweat soldered to the bottom end 34 of the straight end 34 of the hook 24. The fitting 38 is larger in diameter than the channel 42 in the pipe 32, preventing the hook 24 from coming out of the channel 42, while permitting the hook 24 to swivel freely 360 degrees about its longitudinal axis.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims. For example, a vertical member having four or more arms, that is, the vertical member would resemble a cross in a top plan view, instead of the two shown in the preferred embodiment disclosed herein could be fashioned, and would store twice as many caps.

Therefore, scope of the present invention should not be limited by the embodiment disclosed above, but only by the following claims.

I claim:

1. A cap rack comprising a vertically oriented single piece elongated member having a longitudinal axis and having a right-hand side and a left-hand side, a column of slots in said right-hand side and a column of slots in said left-hand side, thereby forming a plurality of adjacent slots in each said column, with all said adjacent slots in each said column being a uniform distance apart and said left-hand side slots being offset from said right-hand side slots by one-half of the distance between said adjacent slots in each said column for maintaining tensile strength of said elongated member and each said slot has parallel side walls.

2. A cap rack in accordance with claim 1 wherein said slots lie at an angle of 15–45 degrees to the horizontal when said cap rack is vertically oriented and each said slot has a front end through which the caps' bills are inserted and a back end toward said longitudinal axis of said elongated body, and said back end of each said slot is lower than said front end of each said slot.

3. A cap rack in accordance with claim 1 wherein said slots lie at an angle of 22.5 degrees to the horizontal.

4. A cap rack according to claim 1 further comprising a swivel means and hook at the top of said cap rack for allowing said cap rack to swivel about said longitudinal axis through 360 degrees of rotation, said swivel means further comprising a vertically aligned bore in the top of said elongated body, a pipe seated in said bore, a hook having a curved upper portion for engaging a clothes rod and a straight portion for seating in said swivel mechanism, said straight portion of said hook portion passing through said pipe and being secured within said swivel means by a fitting fixed to a lower end portion of said straight portion of said hook whereby said hook is free to rotate within said pipe and is retained therein.

5. A cap rack according to claim 2 wherein each said slot further comprises a uniform width from said back end to said front end and said back end of said slot terminates at said longitudinal axis of said elongated member.

6. A cap rack comprising:

a. a vertically oriented single piece elongated member having a longitudinal axis along a vertical center line and having a right-hand side and a left-hand side, a column of parallel slots in said right-hand side and a column of parallel slots in said left-hand side, thereby forming a plurality of adjacent parallel slots in each said column, with all said adjacent slots in each said column being a uniform distance apart and said left-hand side slots being offset from said right-hand side slots by one-half of the distance between said adjacent slots in each said column for maintaining tensile strength of said elongated member and each said slot has parallel side walls, wherein said slots lie at an angle of 15–45 degrees to the horizontal when said cap rack is vertically oriented and each said slot has a front end through which the caps' bills are inserted and a back end toward said longitudinal axis of said elongated member, and said back end of each said slot is lower than said front end of each said slot and each said slot further comprises a uniform width from said back end to said front end and said back ends of all said slots terminate at said longitudinal axis of said elongated member; and b. a blind swivel means and hook at the top of said cap rack for allowing said cap rack to swivel about said longitudinal axis through 360 degrees of rotation, said swivel means further comprising a vertically aligned bore in the top of said body along said longitudinal axis, a pipe seated in said bore, a hook having a curved upper portion for engaging a clothes rod and a straight portion for seating in said swivel mechanism, said straight portion of said hook portion passing through said pipe and being secured within said swivel means by a fitting fixed to a lower end portion of said straight portion of said hook whereby said hook is free to rotate within said pipe and is retained therein.

* * * * *